United States Patent [19]

Luo

[11] Patent Number: 4,614,377

[45] Date of Patent: Sep. 30, 1986

[54] FOLDABLE LOUNGE CHAIR

[76] Inventor: Wun-Thong Luo, 6, Lane 10, Szu Chuan Rd., Sec 1, Pan Chiao, Taipei Hsien, Taiwan

[21] Appl. No.: 783,181

[22] Filed: Oct. 2, 1985

[51] Int. Cl.[4] ..... A47C 4/00

[52] U.S. Cl. ..... 297/19; 297/35; 297/320

[58] Field of Search ..... 297/19, 27, 28, 29, 297/35, 46, 48, 52, 342, 320, 359, 16

[56] References Cited

U.S. PATENT DOCUMENTS

| | | | |
|---|---|---|---|
| 1,727,115 | 9/1929 | Rastetter | 297/48 |
| 2,195,091 | 3/1940 | Lorenz et al. | 297/27 |
| 2,571,463 | 10/1951 | Lorenz | 297/29 |
| 3,934,932 | 1/1976 | Ekornes | 297/230 |

*Primary Examiner*—Francis K. Zugel

*Attorney, Agent, or Firm*—Banner, Birch, McKie & Beckett

[57] ABSTRACT

A foldable lounge chair provided for both sitting and comfortable lounging positions wherein the back of the chair keeps upright while the seat is occupied and when the user lies his back against the back of the chair, the back of the chair inclines gradually backward and simultaneously makes the seat raise from its original lower horizontal position. When the back of the chair is inclined to the desired angle, a inclination setting button can be firmly fastened that the inclined position of the back may thus be set. When the inclination setting button is loosened, or the user no longer lies his back against the back of the chair, the back can automatically return to its original upright position. If not in use, the chair can be quickly folded flat for storage and carrying.

8 Claims, 8 Drawing Figures

FOLDABLE LOUNGE CHAIR

BACKGROUND OF THE INVENTION

The present invention relates to a foldable lounge chair, and more particularly to a comfortable position of the foldable lounge chair which the inclination of the chair back can be adjusted to any suitable position desired by the user. In case of being not used, the chair can be quickly folded flat for storage.

For many years the foldable chair simply has a foldable function only, and be unable to function as a lounging purpose at the same time. Though the conventional lounging chair has its back be adjusted from sitting to lounging, its adjusting method is by means of segment adjustment on pre-set angles. This procedure is not fully able to meet every user's requirement. Due to its complicated construction and huge volume, the conventional lounge chair must be knocked down by hand tool before transport, but its size is still too big to be economical and useful. In addition, the knockdown and assembling procedures or the conventional lounge chair also rather take time.

Accordingly, the present invention is to aim at alleviating the disadvantages of the conventional lounge chair, and providing a foldable lounge chair which can be adjusted completely according to user's posture and moving the weight in the seat so that the desired inclining position can be adjusted gradually to the complete comfort and satisfaction of the user, without any need of adjustment step by step, on a continuous way.

According to the improved lounge chair of the present invention, the most comfortable and convenient purpose can be readily achieved for the user of the chair.

Another aim of the present invention is to make the chair be folded flat as practical as possible without disassembling any part of the chair for easy storage and/or carrying.

DETAILED DESCRIPTION OF THE PREFERRED EMBODIMENT

Figure 1:
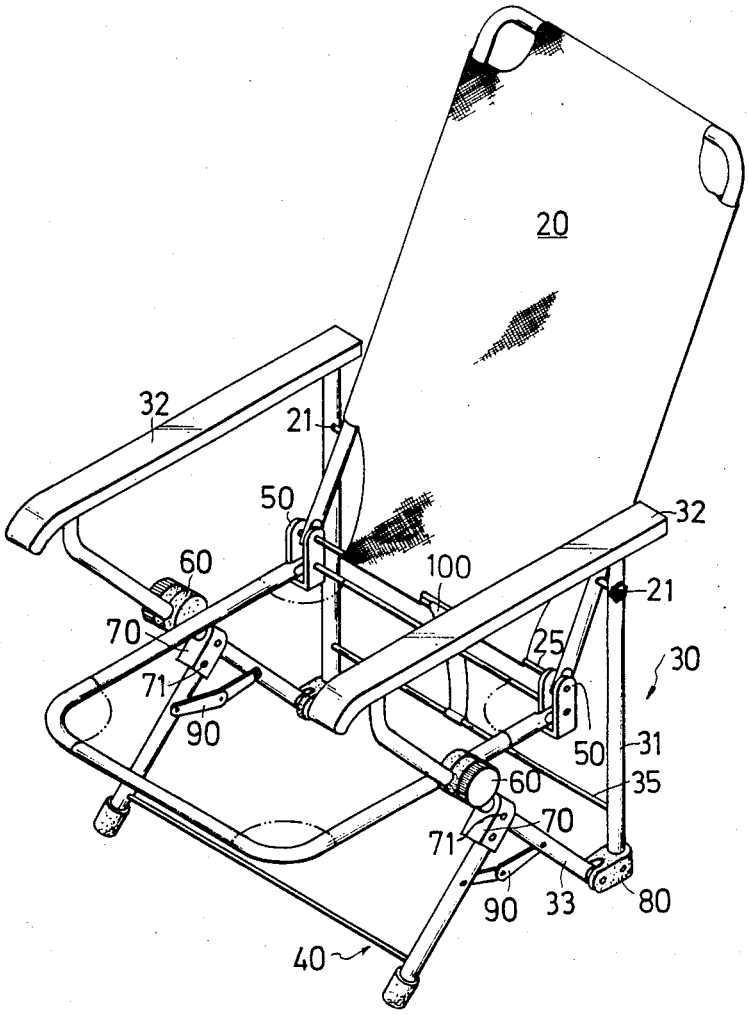
FIG. 1 is a perspective view of the chair shown unfolded manner for use according to the present invention.
Figure 2:
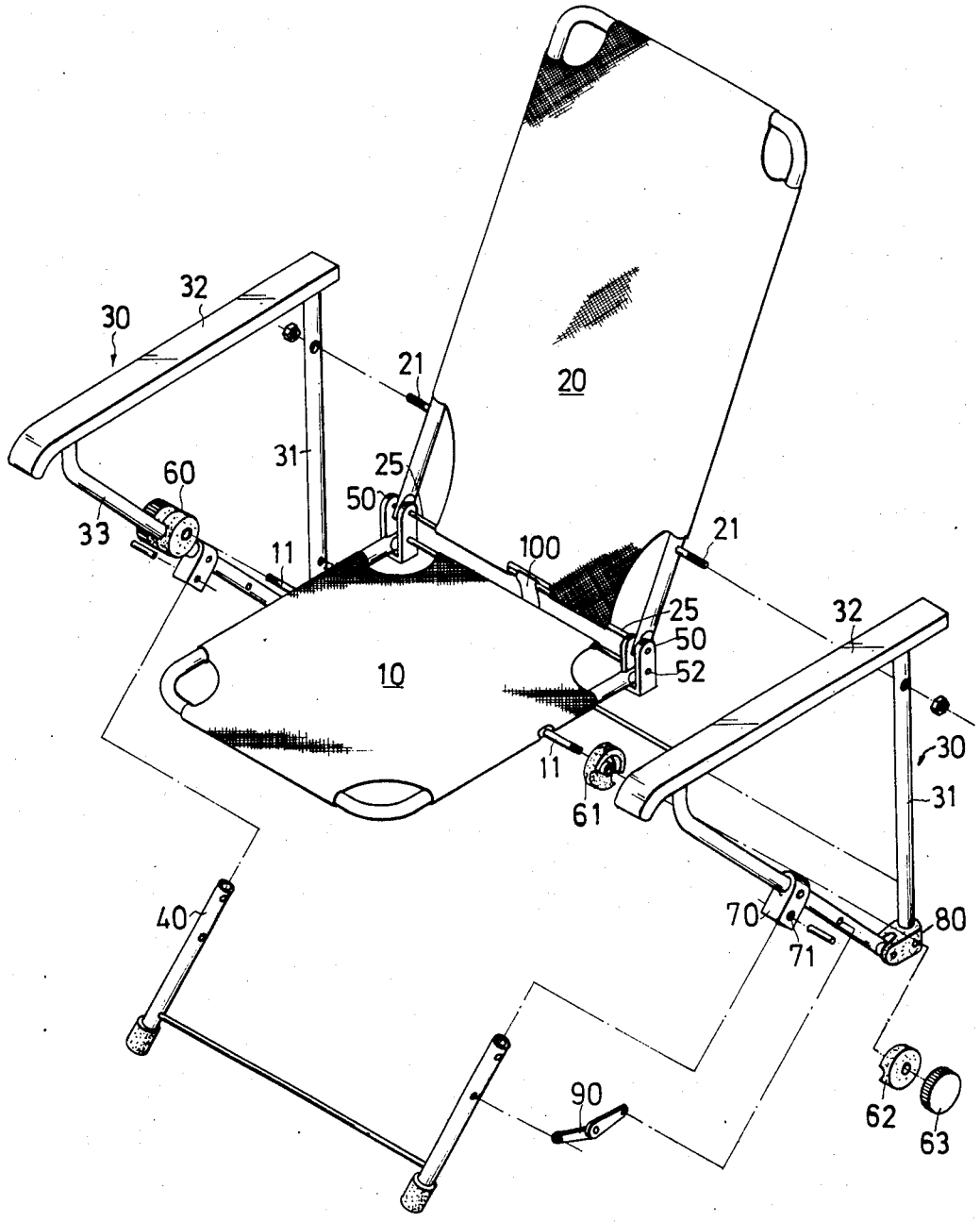
FIG. 2 is an exploded perspective view according to the present invention.
Figure 3:
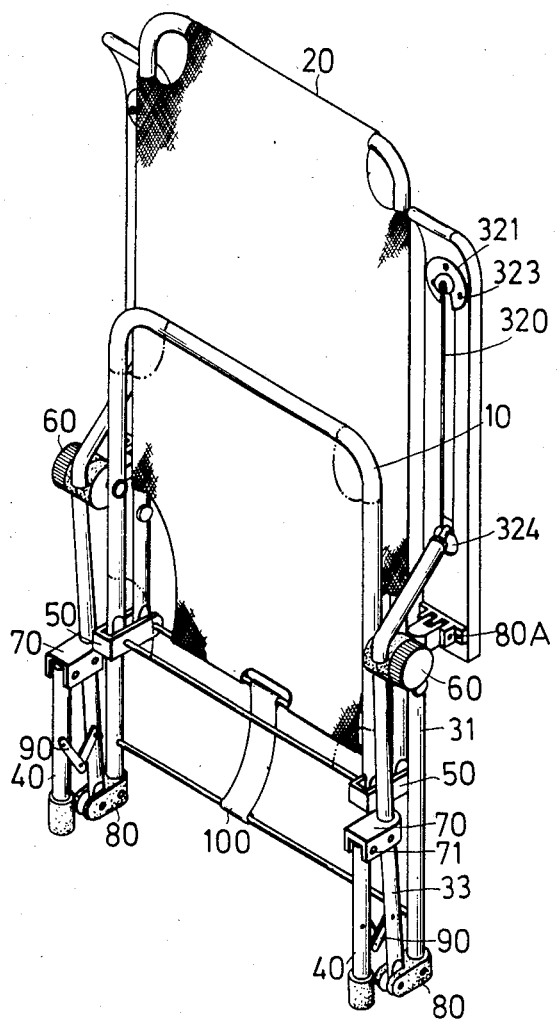
FIG. 3 is a perspective view of the chair shown folded flat for storage according to the present invention.

Referring to the drawing wherein like numbers indicating like elements thoughout the figures, there is a foldable lounge chair as shown in FIGS. 1 and 2. The chair comprises a seat 10, a back 20, and a pair of foldable armrests 30—30, each provided at each side of the seat 10 and the back 20; armrests 30, each including a bevel forwarding supporter 33, an armrest plate 32, and a rear supporter 31; a front foot frame 40 hinged to the lower part of the bevel forwarding supporter 33; an inclination setting button 60 slidably mounted on the bevel forwarding supporter 33; a pair of first "U" shaped joints 50—50 provided at both sides of the rear end of the seat 10 and the bottom of the back 20 making the seat 10 and the back 20 be folded together; a pair of second "U" shaped joints 80—80 provided at the bottom of rear supporters 31—31 and that of the bevel forwarding supporter 33 of the armrests 30—30; a connecting member 35 connected between two rear supporters 31—31 of the armrests 30—30; a pair of third "U" shaped joints 70—70 connected between the front foot frame 40 and the bevel forwarding supporters 33—33 of the armrests 30—30; a pair of fourth joints 80A—80A provided between the rear of the armrest plates 32—32 and the top of the rear supporters 31—31 capable of being moved the armrest plates 32—32 upward and keeps upright position from the top of the supporters 31—31 as shown in FIG. 3. The bottom of the back 20 is hinged with supporting axes 21—21 which projected from the both side frame of the back 20 and installed at the upper portion of the rear supporters 31—31, respectively. Each bevel forwarding supporter 33 is installed in a bevel way below the front of each armrest plate 32. A "T" shaped groove 320 is longitudinally undercut at the bottm of each armrest plate 32 (see FIG. 5B), the front end of the "T" shaped groove 320 is "C" shaped stop plate 321 and inside the stop plate 321 is further installed with a "C" shaped stop pad 322 (see FIG. 5C) which is fastened by the bolts 323 below the front part of each armrest plate 32. There is an inlet recess 324 at the rear portion of each "T" shaped groove 320 (see FIG. 3). The bottoms of the bevel forwarding supporters 33—33 and the that of the rear supporters 31—31 are both hinged together by the second joints 80—80 so that the bevel forwarding supporters 33—33 can be folded inward with force on the rear supporters 31—31. A pair of hinge shaft 11—11 are protruding from the sides of the frame of the seat 10 (see FIG. 2). The inclination setting button 60 includes buckle covers 61, 62 and a nut cover 63. Both covers 61, 62 each provides a curved groove 611, 612 offset from the center portion thereof, respectively. The buckle covers 61, 62 are provided to fasten the nut cover 63 by means of the hinge shaft 11 with its male screw 110 and female screw 630 provided at the center projection 631 of the nut cover 63, sandwiching the upper part of the bevel forwarding supporter 33 therebetween. By means of the inclination setting button 60, the slide of up and down can be fastened on the bevel forwarding supporter 33. In order to change the inclination of the back 20, the seat 10 may slide at ease on the upper part of the bevel forwarding supporter 33 by means of the inclination setting button 60. In order to slidably and firmly support the armrest plate 32 with the bevel forwarding supporter 33, the top end of the bevel forwarding supporter 33 is further provided with a "T" shaped head 331 and the upper portion thereof is bent to keep it in a upright position with the armrest plate 32, so as to enable the top of the supporter 33 to be smoothly moved within the "T" shaped groove 320, if the chair of the present invention is to be folded (see FIG. 4). Under the inclination setting button 60, and at the bevel forwarding supporter 33, there is the third joint 70 facing downward in a bevel way to hinge the "H" shaped front foot frame 40. The hinge pin 71 may be used as a support point for the frame 40 moving inward and coming close to the bevel forwarding supporter 33 when a push is made from outside (as shown in FIG. 3). In order to function as a support easily, the supporting bars 90—90 are further installed between the front foot frame 40 and the pair of bevel forwarding supporters 33—33. Besides, the flexible limited member 100 is provided between the connecting member 35 which links between two rear supporters 31—31 of the armrest 30, and the framed bar 25 below the back 20 to prevent the back 20 from excessive inclination.

Figure 4:
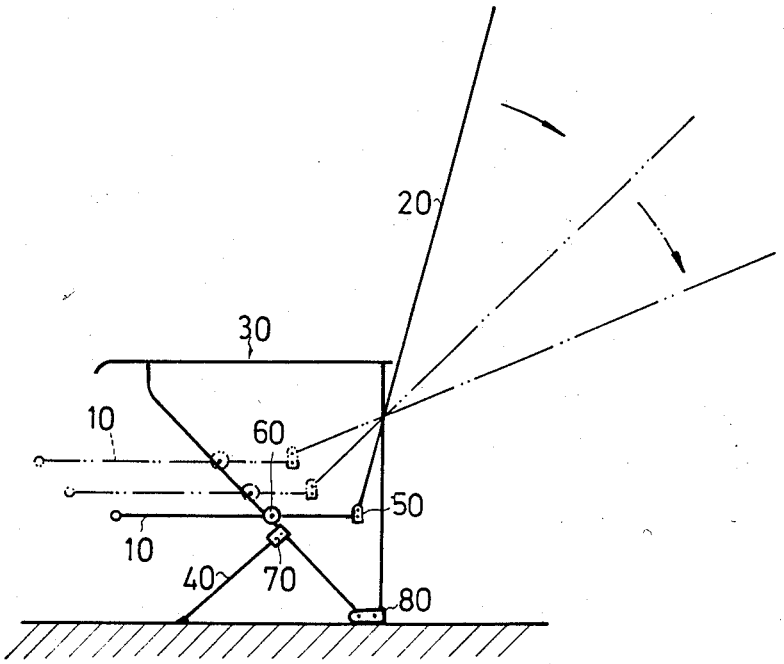
FIG. 4 is a schematic view of the chair showing possible inclination positions according to the present invention.
Figure 5A:
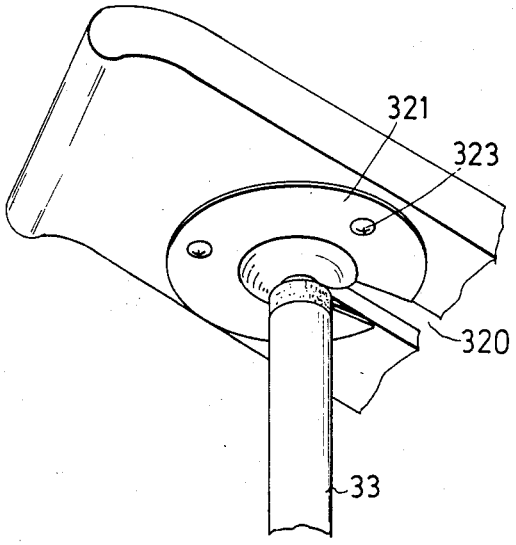
FIG. 5A is an end elevation view showing the armrest according to the present invention.
Figure 5B:
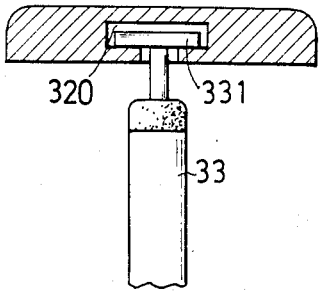
FIG. 5B is a side elevation view, partially in section, of the armrest plate showing a removable "T" shaped head and a undercut "T" shaped groove of armrest plate according to the present invention.
Figure 5C:
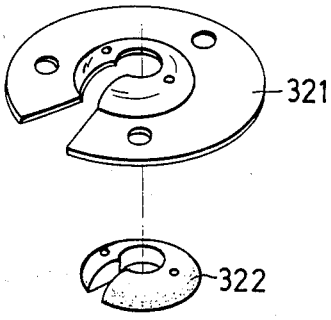
FIG. 5C is a perspective view showing the "C" shaped end plate below the end of armrest plate and "C" shaped stop pad.
Figure 6:
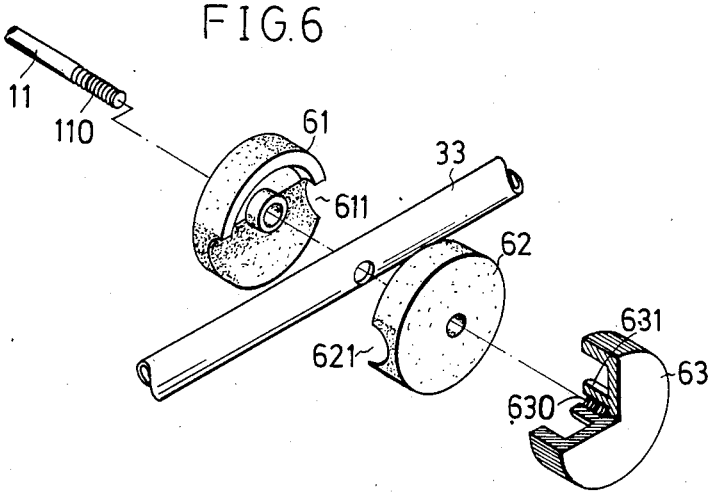
FIG. 6 is an exploded perspective view of an inclination setting button for the chair according to the present invention.

In using, when the seat 10 is occupied, and no pressure lies against the back 20, the back 20 keeps upright position with the seat 10. In this manner, the inclination setting buttons 60—60 may close to the third joints 70—70 which is mounted at the middle of the bevel forwarding supporter 33. When the user lies his back against the back 20 of the chair, the back 20 is gradually inclining backward due to the back 20 being supported by the hinge shaft 21. As the back 20 and the seat 10 are hinged by the first "U" shaped joints 50—50 and are supported by the hinge shafts 11—11, 21—21 separately located at the both sides of the seat 10 and the back 20, when the back 20 is applied with a force by the user, the seat 10 will gradually raise from its original lower horizontal position according to the extent of the inclination of the back 20. The inclination setting button 60 may slide upward on the upper half of the bevel forwarding supporter 33 (as shown in FIG. 4). In case the user feels the inclination of the back 20 come to the most comfortable position, the inclination setting button 60 can be fastened with nut cover 63 and buckle covers 61, 62 firmly in order to set the inclining position. In case of return to an original upright position, simply decrease the wright lying against the back 20, and increase the weight in the seat 10 by loosening the nut cover 63 of the button 60, the back 20 returns quickly to its original upright position.

If not in use or for carrying, to save the storage space for the chair, just a push of the "H" shaped front foot frame 40 makes it close to the bevel forwarding supporters 33—33 and again turns the seat 10 out upward for being folded together with the back 20. Simultaneously the armrest plates 32—32 will go upward and keep upright position. The "T" shaped head 331 at the top of the bevel forwarding supporter 33 will slide backward along the "T" shaped groove 320 inside the armrest plates 32—32 and closes to the point near the inlet recess 324. The complete chair is eventually folded flat as shown in FIG. 2.

I claim:

1. A foldable lounge chair comprising a seat having a first pair of hinge means protruding from the both sides thereof, respectively;

a back having a second pair of hinge means protruding from the both sides thereof, respectively, the bottom of the back and the rear of the seat being hinged together;

a pair of armrests provided at both sides of the seat and the back, each including a armrest plate provided on the top of each armrest, a longitudinal groove being undercut therein;

a rear supporter vertically hinged below the rear part of the armrest plate, the lower portions of the rear supporters being connected by a connecting member, the upper portion of each rear supporter provided with a axial hole means, the second pair of hinge means of the back extending through the axial holes means to thereby form a supporting point for the back;

a bevel forwarding supporter, the top thereof being slidably mounted under the front of the armrest plate and the bottom thereof being hinged together with that of the rear supporter so that the bevel forwarding supporter is arranged in a bevel way below the armrest plate;

a pair of inclination setting means slidably mounted on the pair of bevel forwarding supporters and axially fixed by the first pair of hinge means of the seat;

a "H" shaped front frame obliquely hinged to said pair of bevel forwarding supporters, respectively;

when the seat is occupied, the weight applied thereon rendering the inclination setting means against the junction of the bevel forwarding supporters and the "H" shaped front frame and staying at the lowest position thereof; when the back being applied with a force, the back, with the second pair of hinge means, automatically inclining backward gradually to a desired inclination position, and simultaneously the seat also raising gradually from its original lower horizontal position to the higher horizontal position and the inclination setting means being slid upward along the bevel forwarding supporter; when the force applied to the back is decreased and increased to the seat, the back automatically returning to its original upright position.

2. A foldable lounge chair as claimed in claim 1, wherein a first "U" shaped joint means is further provided between the rear of the seat and the bottom of the back so that both of them can be folded together.

3. A foldable lounge chair as claimed in claim 1, wherein the bottom of the rear supporters of the armrest and that of the bevel forwarding supporters are hinged together by a second "U" shaped joint means to enable said bevel forwarding supporter to be close near to said rear surporter of armrest upon application the force thereon.

4. A foldable lounge chair as claimed in claim 1, wherein a third joint means is further provided between the bevel forwarding suporter and the "H" shaped front frame to enable said "H" shaped front frame to close near to the bevel forwarding supporter upon application the force thereon.

5. A foldable lounge chair as claimed in claim 1, wherein the top of said bevel forwarding supporter is formed of a "T" shaped head capable of being slidable within the undercut groove of said armrest plate when the chair is desired to be folded.

6. A foldable lounge chair as claimed in claim 1, wherein a flexible limit member is further provided between the connecting member of said pair of the rear supporters of the armrests and the bottom frame of the back to prevent the back from being excessively inclined.

7. A foldable lounge chair as claimed in claim 5, wherein the undercut groove of the armrest plate comprises an inlet means provided at the rear of the armrest plate for access of the "T" shaped head into the groove and a stopper means provided at the front of the armrest plate for holding said "T" shaped head therein.

8. A foldable lounge chair as claimed in claim 5, wherein the complete set of the chair can be folded in a form of flat configuration by a push of the "H" shaped front frame making it close to the bevel forwarding supporter, turning the seat out upward for being folded together with the back, simultaneously the armrest plates going upward and keeping upright position so that the "T" shaped head of the bevel forwarding supporter will slide backward along the undercut "T" shaped groove and close to the portion near the inlet recess.

* * * * *